US005201194A

United States Patent [19]

Flynn, Jr. et al.

[11] Patent Number: 5,201,194

[45] Date of Patent: Apr. 13, 1993

[54] FOOD SERVING AND STORAGE CONTAINER

[76] Inventors: Martin F. Flynn, Jr., 12 Blakely Rd., Downingtown, Pa. 19335; Noel Yapsuga, 1707 Main St., Northampton, Pa. 18067

[21] Appl. No.: 816,004

[22] Filed: Jan. 2, 1992

[51] Int. Cl.[5] ..... F25D 3/08

[52] U.S. Cl. ..... 62/457.3; 62/457.2

[58] Field of Search ..... 62/457.1, 457.2, 457.3, 62/457.6, 457.7, 371

[56] References Cited

U.S. PATENT DOCUMENTS

| | | | |
|---|---|---|---|
| 347,049 | 8/1886 | Kavanagh | 62/457.7 |
| 712,921 | 11/1902 | Florang | 62/457.7 |
| 776,363 | 11/1904 | Snyder | 62/457 |
| 1,123,793 | 1/1915 | Pick | 62/457 |
| 1,441,832 | 1/1923 | Collins | 62/463 |
| 1,696,349 | 12/1928 | Fritz | 62/463 |
| 1,720,935 | 7/1929 | Tressel | 62/464 |
| 1,731,604 | 10/1929 | Allen | 62/463 |
| 1,754,594 | 4/1930 | Bens | 62/457.6 |
| 1,854,169 | 4/1932 | Fryhofer | 62/457 |
| 1,999,670 | 4/1935 | Strouse et al. | 62/76 |
| 2,048,041 | 7/1936 | Warren et al. | 62/457.3 |
| 2,168,969 | 8/1939 | Bickerstaff | 62/463 |
| 2,526,165 | 10/1950 | Smith | 62/1 |
| 2,779,495 | 1/1957 | Davis | 62/457.1 |
| 2,838,916 | 6/1958 | Sola | 62/457.3 |
| 3,059,452 | 10/1962 | Griffin | 62/457 |
| 3,205,677 | 9/1965 | Stoner | 62/457.3 |
| 3,338,068 | 8/1967 | Piker | 62/398 |
| 3,429,141 | 2/1969 | Halseth | 62/372 |
| 4,024,731 | 5/1977 | Branscum | 62/457 |
| 4,050,264 | 9/1977 | Tanaka | 62/457 |
| 4,319,629 | 3/1982 | Hotta | 165/47 |
| 4,514,993 | 5/1985 | Johnson | 62/372 |
| 4,653,290 | 3/1987 | Byrne | 62/372 |
| 4,793,149 | 12/1988 | Riche | 62/293 |
| 4,831,842 | 5/1989 | Kelley et al. | 62/457.4 |
| 4,989,419 | 2/1991 | Brando et al. | 62/457.2 |

*Primary Examiner*—Albert J. Makay
*Assistant Examiner*—William C. Doerrler
*Attorney, Agent, or Firm*—Michael F. Petock

[57] ABSTRACT

An article of manufacture in the form of a container for serving and storing food is provided with inner and outer sidewalls. The inner and outer sidewalls are disposed and configured to provide a space therebetween which is adapted to receive a coolant. The coolant is configured to fit into the space between the inner and outer sidewalls and provide a substantially uniform cooling to the food stored in the container. The container may be provided with a tray and a receptacle for an absorbent material to absorb condensate from the outer wall.

16 Claims, 4 Drawing Sheets

FIG. 1
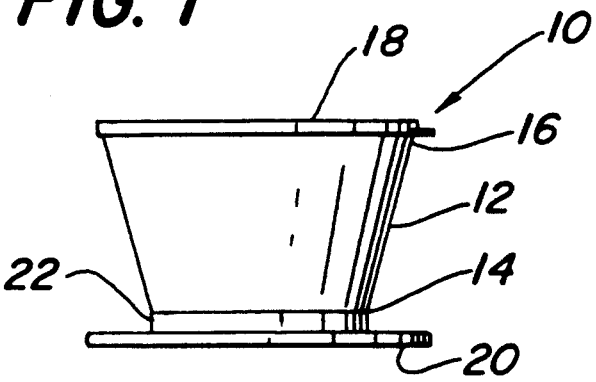
FIG. 2
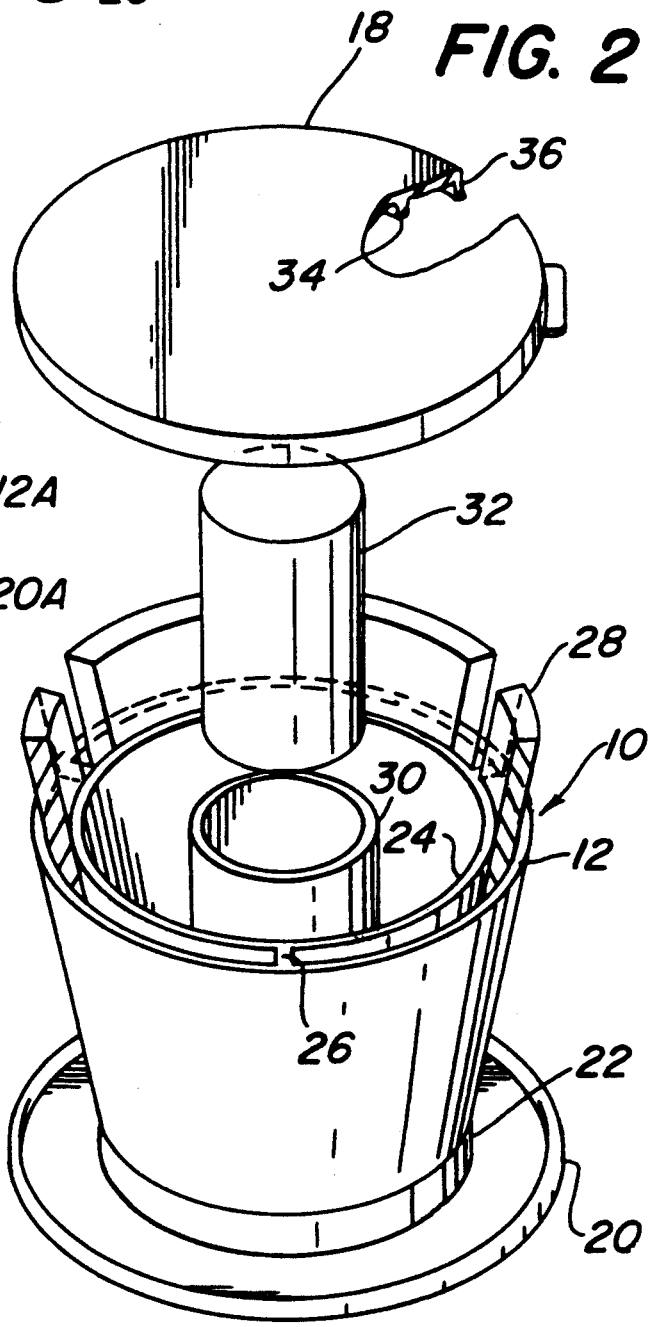
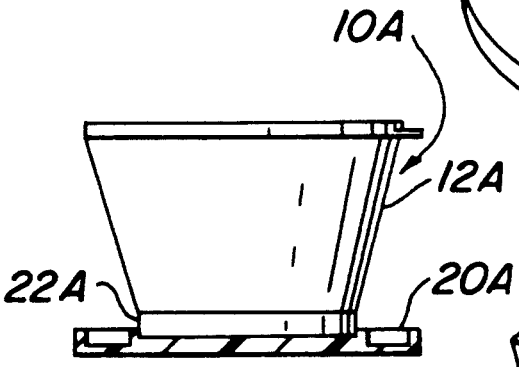
FIG. 1A

FIG. 3
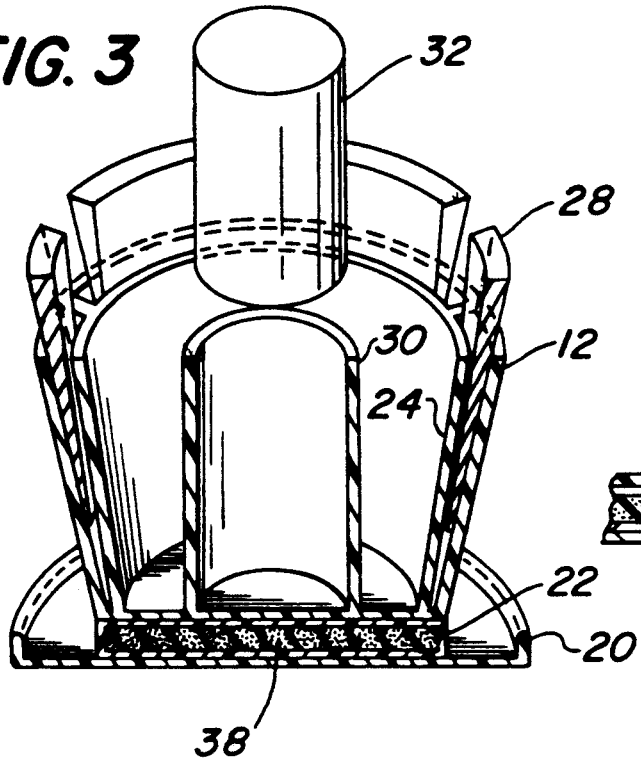
FIG. 5
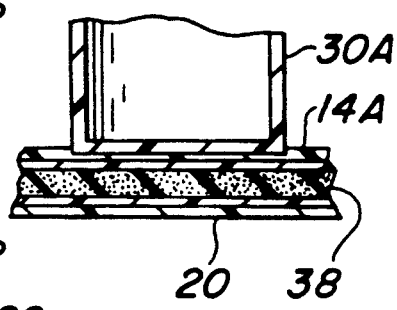
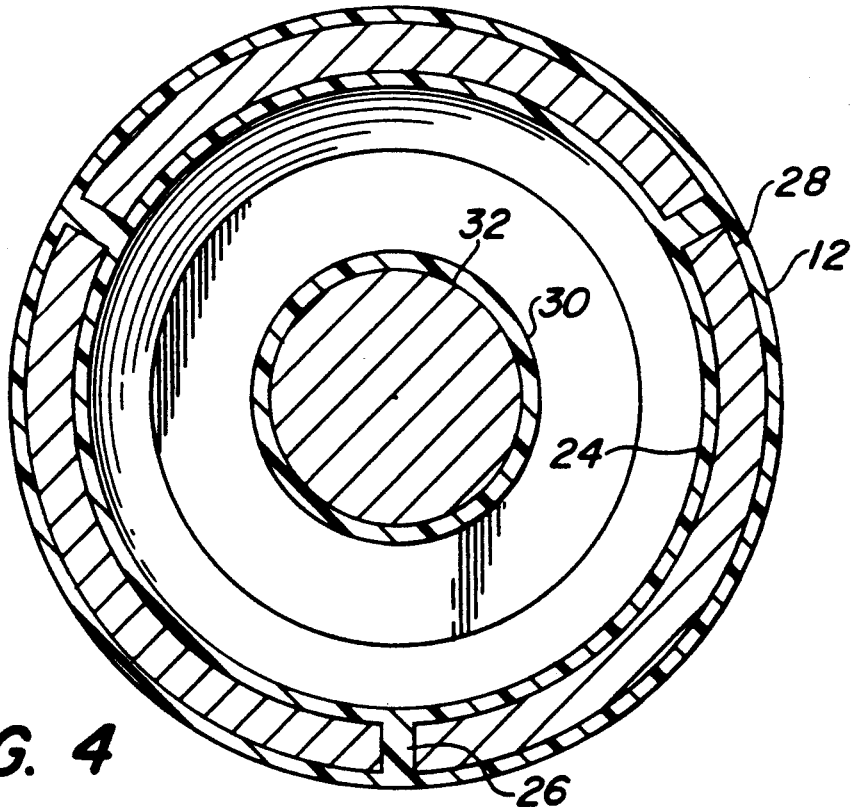
FIG. 4

FIG. 6
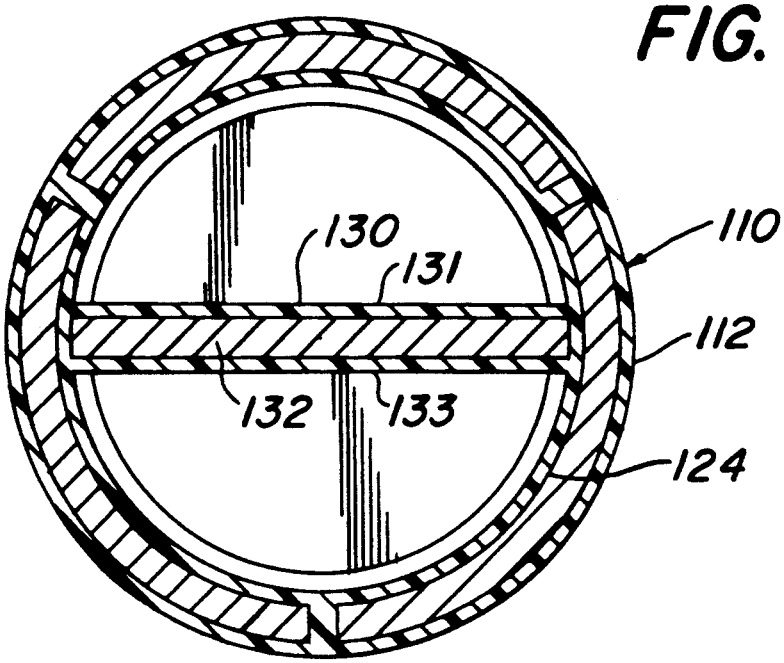
FIG. 7
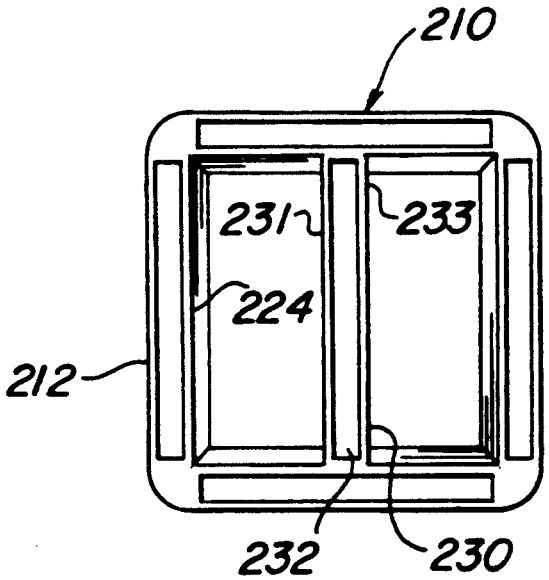
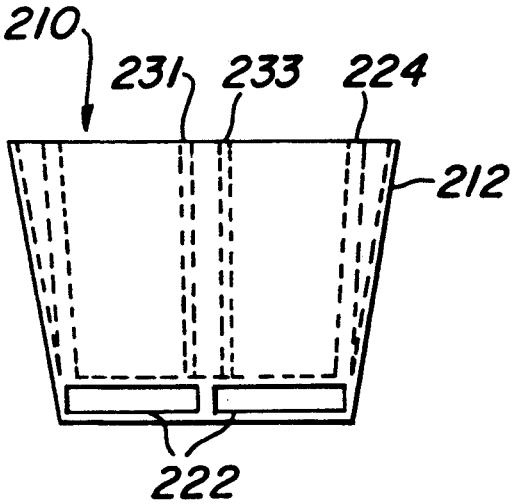
FIG. 8

FOOD SERVING AND STORAGE CONTAINER

BACKGROUND OF THE INVENTION

The present invention relates to a new and improved food serving and storage container, more particularly, the present invention relates to a food serving and storage container which may be utilized to maintain food in a cooled condition.

Although cooling chests for transporting and storing various types of food items had been known, there has been a long felt need for a food server and storage container in which various types of foods such as potato salad, tuna salad and various other foods may be stored directly and served, particularly at picnics, outings and the like. Although a cooling chest may serve to maintain the foods in a cooled state during transport to the picnic or outing, there was a long felt need for a container in which such foods could be stored, maintained cool both during transport and during the serving process. Quite commonly, such foods will be placed out on a picnic or buffet table for hours during an outing event. Such foods, although perfectly wholesome when first placed out for service, may present substantial risk of botulism, salmonella poisoning or other risks as a result of the growth of microorganisms as a result of inadequate cooling, as is well well known This is particularly the case with respect to potato salad, tuna fish salad and other similar types of foods which are particularly susceptible to creating such risks.

The present invention is particularly adapted to the serving and maintaining cool of such foods which do not have their own containers, such as salads and the like.

SUMMARY OF THE INVENTION

The present invention is directed to an article of manufacture which comprises a food serving and storage container having an inner and an outer sidewall. The inner and outer sidewalls are so disposed and configured to provide a space therebetween and adapted to receive a coolant so configured to provide substantially uniform cooling.

Various other embodiments also provide advantages such as the providing of a tray spaced from the bottom wall of the container to provide a space which is adapted to receive an absorbent material which may absorb condensate which forms on the outer surface of the container and runs into the tray.

The present invention may also be provided with a centrally disposed receptacle for receiving additional coolant to maintain the cooling function uniformly throughout, particularly where the container is of larger size.

Other various embodiments of the invention include multiple compartments within the container each compartment being separated by a double wall so disposed and configured as to receive a coolant between the space formed by the double wall.

Various other embodiments and advantages of the present invention will be described in greater detail hereinafter.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in elevation of a container in accordance with the present invention.

FIG. 1A is an elevation view, partially in cross section of another embodiment of the present invention.

FIG. 2 is a perspective view, partially broken away and partially exploded of a container in accordance with the present invention.

FIG. 3 is a cross-sectional view in perspective of another embodiment of the present invention.

FIG. 4 is a cross-sectional view taken through a container in accordance with the present invention.

FIG. 5 is a broken away cross-sectional view of a portion of a container similar to that shown in FIG. 3, but having a removable receptacle for the central coolant.

FIG. 6 is a cross sectional view of another embodiment of the present invention.

FIG. 7 is a plan view of another embodiment of the present invention.

FIG. 8 is an elevation view of an embodiment of the present invention shown in FIG. 7, showing certain internal compartments in dotted lines.

DETAILED DESCRIPTION OF THE PREFERRED EMBODIMENTS

Figure 9:
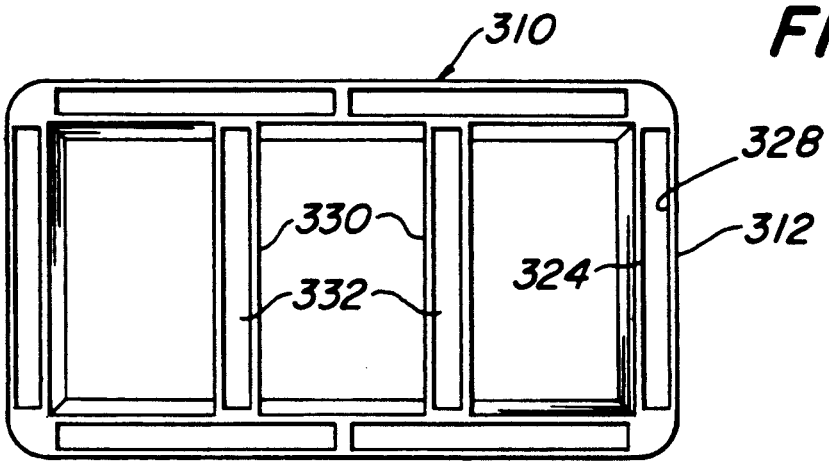
FIG. 9 is a plan view of another embodiment of the present invention.

Referring now to the drawings, wherein like numerals indicate like elements, there is shown in FIG. 1 an elevation view of a container 10 in accordance with the present invention. Container 10 is provided with outer sidewalls 12 which flair outwardly from the bottom 14 to the top 16. Container 10 is provided with a cover 18 and a tray 24 catching condensate. Between the bottom 14 of the sidewalls 12 and a tray 20, there is provided a structure 22 for receiving a sponge or the like for the absorption of condensate on the tray.

FIG. 1A discloses an alternate embodiment of the container shown in FIG. 1 wherein the container 10A comprised of sidewalls 12A and sponge receptacle 22A is removable from tray 20A. The embodiments of FIGS. 1 and 1A are otherwise identical.

Referring now to FIGS. 2, 3 and 4, there is an expanded view of the embodiment shown in either FIGS. 1 or 1A wherein it is illustrated that the container 10 is provided with outer sidewall 12 and inner sidewall 24. The inner and outer side-walls may be connected and supported vis-a-vis each other via connecting structure 26. Substantially wedge-shaped coolant 28 may be inserted between the inner walls 24 and the outer walls 12. The coolant may take the form of ice frozen in the shape adapted to fit between the inner and outer walls 24 and 12, or may take the form of containers having a freezable fluid of a shape adapted to fit between the inner and outer walls 24 and 12, respectively.

Container 10 is provided with a centrally disposed coolant receptacle 30. Centrally disposed receptacle 30 may be cylindrical in shape or the shape of a truncated cone which will more uniformly provide coolant to the food to be contained within container 10. Coolant 32 which is adapted to fit into centrally disposed coolant receptacle 30 will be adapted to be of a mating shape.

As may be seen in the broken away portion of the cover 18 of FIG. 2, cover 18 is provided with an inner lip 34 and an outer lip 36. Inner lip 34 mates with the inner surface of inner wall 24 and outer lip 36 mates with the outer surface o outer wall 12 to provide a tight seal. This is particularly advantageous if coolant 28 is in the form of meltable ice, as lips 34 and 36 will provide a seal to prevent water from the melted ice from possibly running into the food within container 10 if container 10 is tilted.

Referring particularly now to FIG. 3, the structure described in FIG. 2 is shown in cross section in greater detail. Again, identical numbers have been applied, as described with respect to FIG. 2. Additionally, the structure of sponge receptacle 22 is shown in cross section in greater detail. It is understood that although it is referred to as a sponge, any suitable absorbent material may be utilized to absorb condensate from tray 20. Sponge 38 is contained within structure 22.

FIG. 5 shows an alternate embodiment of the present invention wherein the centrally disposed coolant receptacle 30 previously described is a removable structure 30A. 30A is removable from a recessed bottom 14A. Otherwise, the structure is identical to that shown in FIGS. 2 through 4.

FIG. 6 is a cross-sectional view of a alternate embodiment wherein a container 110 is provided with outer walls 112 and inner walls 124. Container 110 is provided with a diagonally arranged coolant receptacle 130 comprised of side-walls 131 and 133 which receives a coolant 132 which again may be in the form of ice frozen in a shape especially adapted to mate with diagonal receptacle 130 or with a container adapted to be received within receptacle 130 which contains a freezable fluid. As may be seen from the cross-sectional plan view of FIG. 6, the coolant is rectangular as viewed in plan, and is trapezoidal when viewed in elevation as side view of the container of FIG. 6 is similar to that shown in FIGS. 1, 2 and 3.

Referring now to FIGS. 7 and 8, there is shown another embodiment of the present invention. FIG. 7 is a plan view of the container 210 which is substantially square as viewed in the plan view of FIG. 7. Container 210 is provided with, as viewed in FIGS. 7 and 8, outer walls 212 and inner walls 224. An internal coolant receptacle 230 is provided with walls 231 and 233. Receptacle 230 receives a coolant similar to that as described with respect to FIG. 6. FIG. 8 also illustrates receptacle 222 for the sponge or other absorbent material.

Figure 10:
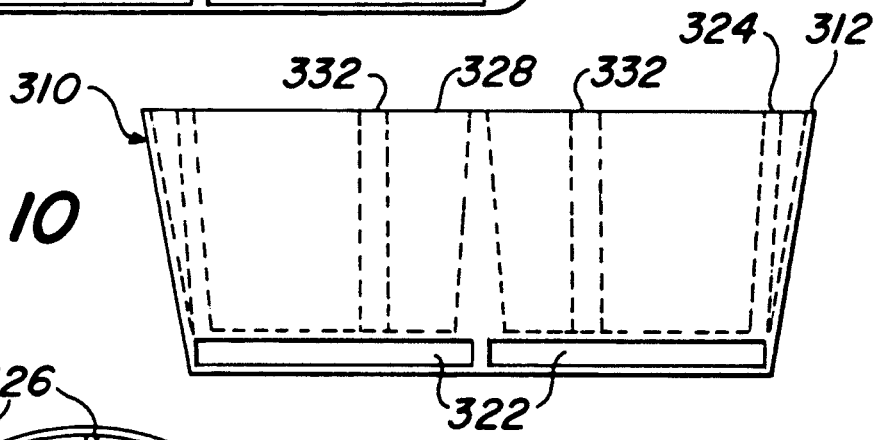
FIG. 10 is an elevation view of FIG. 9 showing certain internal compartments in dotted lines.

Referring now to FIGS. 9 and 10, there is shown another embodiment of the present invention wherein container 310 shown in FIGS. 9 and 10 is substantially rectangular in plan view. Container 310 is provided with outer walls 312 and inner wall 324 which are adapted to receive a coolant 328 therebetween. Container 310 is provided with two internal coolant receptacles 330 adapted to receive coolants 332. Container 310 is also provided with a pair of sponge or other absorbent receptacles 322.

Figure 11:
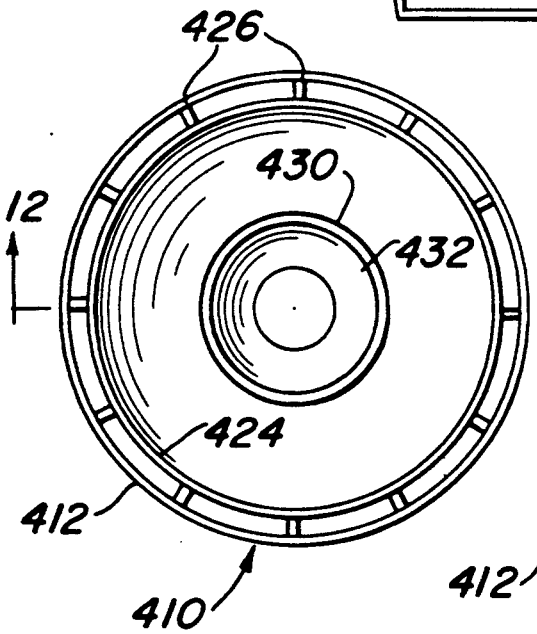
FIG. 11 is a plan view of another embodiment of the present invention.
Figure 12:
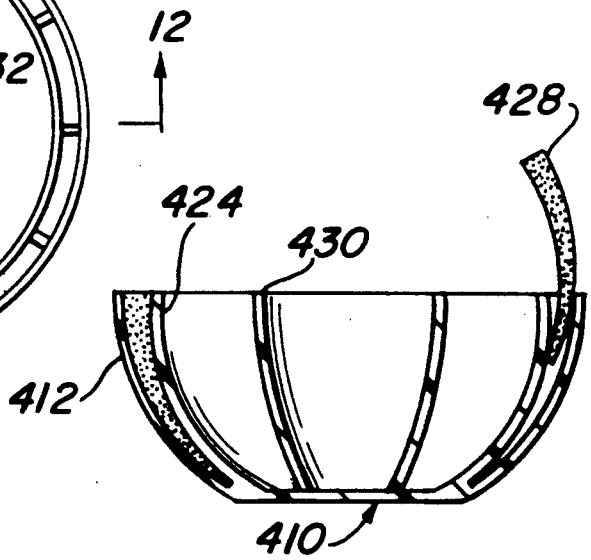
FIG. 12 is an elevation view in cross section of the embodiment shown in FIG. 11.

Referring now to FIGS. 11 and 12, there is shown another embodiment of the present invention wherein a food container 410 is shown having outer sidewalls 412 and inner sidewalls 424. The inner and outer sidewalls are connected together by a plurality of spacers 426. Narrow curved coolant whether they be in the form of ice or coolant containers 428 are adapted to be inserted between the inner and outer walls 424 and 412, respectively. The embodiment shown in FIGS. 11 and 12 is also provided with a central coolant container 430 which is adapted to receive a coolant 432. Container 410 may also be provided with a tray as described in connection with either FIGS. 1 or 1A and the central coolant container 430 may be permanently installed as shown in FIG. 3 or removable as shown in FIG. 5.

In view of the above the present invention may be embodied in other specific forms without departing from the spirit or essential attributes thereof and, accordingly, reference should be made to the appended claims, rather than to the foregoing specification as indicating the scope of the invention.

We claim:

1. An article of manufacture comprising:

a food serving and storage container having an inner and an outer sidewall, said inner and outer sidewalls being so disposed and configured to provide a space therebetween and adapted to receive a coolant so configured to provide substantially uniform cooling, said space between said inner and outer sidewalls being open from above to enable insertion and removal of said coolant, said coolant being a freezable fluid contained in a sealed container and adapted and configured to be slidably received in said space between said inner and outer sidewalls.

2. An article of manufacture in accordance with claim 1, wherein a tray is provided under a bottom wall of said container, said tray being a predetermined distance below said bottom to provide a condensate catching space, an absorbent material mounted in said condensate catching space and in communication with said tray to absorb condensate.

3. An article of manufacture in accordance with claim 1 wherein said container is provided with a centrally disposed receptacle for removably receiving a coolant.

4. A coolant container adapted for use with the article of claim 1, including a coolant container configured to be slidably removably received within the space between said inner and outer sidewalls.

5. An article of manufacture in accordance with claim 1 wherein said container and said space have a dimension measured in planes parallel to a bottom of the container which increases as measured in said planes proceeding away from said bottom.

6. An article of manufacture in accordance with claim 1 wherein said container flares outwardly from its bottom and said space viewed in vertical cross section is wedge shaped.

7. An article of manufacture in accordance with claim 1 wherein said container has a plurality of compartments and each compartment is separated by a double wall so disposed and configured as to receive a coolant.

8. An article of manufacture in accordance with claim 2 wherein said absorbent material is comprised of sponge.

9. An article of manufacture in accordance with claim 1 wherein said container is provided with a lid.

10. An article of manufacture in accordance with claim 1 wherein said container is circular in cross section in planes parallel to its bottom.

11. An article of manufacture in accordance with claim 1 wherein said container is substantially rectangular in cross section in planes parallel to its bottom.

12. An article of manufacture in accordance with claim 1 wherein said container is substantially square in cross section in planes parallel to its bottom.

13. A coolant container comprising a sealed container containing a freezable substance, said container having a substantially wedge shape in cross section, said sealed container being shaped to be removably insertable between a pair of walls of a food serving container.

14. A coolant container in accordance with claim 13 wherein said coolant container is provided with the shape of an arc of a circle passing perpendicularly through said wedge shape cross section.

15. A coolant container in accordance with claim 13 wherein said coolant container is provided with a linear shape in the direction perpendicular to the wedge shape cross section.

16. A coolant container in accordance with claim 1 wherein said container is provided with a cover.

* * * * *